US007283781B2

(12) United States Patent
Thayer

(10) Patent No.: US 7,283,781 B2
(45) Date of Patent: Oct. 16, 2007

(54) HIGH LOAD LOW LOAD CLEANING BLADE ASSEMBLY

(75) Inventor: Bruce E. Thayer, Webster, NY (US)

(73) Assignee: Xerox Corporation, Stamford, CT (US)

( * ) Notice: Subject to any disclaimer, the term of this patent is extended or adjusted under 35 U.S.C. 154(b) by 228 days.

(21) Appl. No.: 11/182,286

(22) Filed: Jul. 14, 2005

(65) Prior Publication Data

US 2007/0014606 A1 Jan. 18, 2007

(51) Int. Cl.
*G03G 21/00* (2006.01)

(52) U.S. Cl. ..... 399/350; 399/351

(58) Field of Classification Search ..... 399/350, 399/351; 15/1.51, 256.5, 256.51
See application file for complete search history.

(56) References Cited

U.S. PATENT DOCUMENTS 4,519,698 A 5/1985 Kohyama et al.
4,803,752 A * 2/1989 Kasama ..... 15/256.51
4,825,249 A 4/1989 Oki et al.
5,241,350 A * 8/1993 Bigelow ..... 399/351
5,450,184 A 9/1995 Yanai et al.
5,608,509 A * 3/1997 Shirai et al. ..... 399/351
7,065,317 B2 * 6/2006 Suda ..... 399/350
7,181,156 B2 * 2/2007 Kabata et al. ..... 399/351

* cited by examiner

*Primary Examiner*—William J. Royer
(74) *Attorney, Agent, or Firm*—Tallam I. Nguti

(57) ABSTRACT

A high load low load cleaning blade assembly provided for cleaning a toner image bearing surface includes a blade member having a first edge mounted to a frame, a second and opposite edge for contacting and loading against the toner image bearing surface, and a blade width connecting the first edge to the second edge. The high load low load blade assembly also includes a blade holder for holding and loading the blade member against the moving toner image bearing surface. The blade holder includes a frame, and a blade loading plate operatively connected to the frame and extending from the frame towards the second edge of the blade member for stiffening the blade width and determining a resulting blade loading force of each portion of the second edge against regions of the toner image bearing surface. The blade loading plate includes a central segment having a first plate width for stiffening the central portion of the blade member, and end segments, each having a second plate width less than the first plate width, for stiffening end portions of the blade member, thereby resulting in a second edge having a high load central portion and low load end portions.

20 Claims, 3 Drawing Sheets

HIGH LOAD LOW LOAD CLEANING BLADE ASSEMBLY

The present invention relates to toner imaging machines, such as xerographic printing machines, and more specifically, to such a machine including a high load low load cleaning blade assembly for cleaning both the central imaging region and the inboard and outboard edge regions of a moving image bearing surface within such a machine without undesirable abrasion and scratching.

The basic principles of electrostatographic printing with dry marking material (hereinafter generally referred to as xerography) are well known: an electrostatic latent image is created on a charge-retentive surface, such as a photoreceptor or other charge receptor, and the latent image is developed by exposing it to a supply of toner particles, which are attracted as needed to appropriately-charged areas of the latent image. The toner particles are then transferred in image-wise fashion from the photoreceptor to a print sheet, the print sheet being subsequently heated to permanently fuse the toner particles thereto to form a durable image.

Following the transfer of the image from the photoreceptor to the print sheet, residual toner particles remaining on the photoreceptor are removed or cleaned by any number of known means, such as including a cleaning blade, brush, and/or vacuum. In a typical embodiment, the removed residual toner is then collected directly into a hopper, from where it is then removed, typically for example by means of an auger, into a waste container.

Examples of such cleaning efforts including cleaning blades can be found in the following references. U.S. Pat. No. 4,519,698 entitled "Image forming apparatus including a cleaning blade and drum lubricant" discloses an image forming apparatus comprises a rotatable photosensitive drum driving mechanism for rotating the photosensitive drum; and a cleaning blade which is capable of being in contact with the outer circumferential surface of the photosensitive drum. The cleaning blade removes a residual developer on the outer circumferential surface upon contact with the drum. A recess is formed at part of the outer circumferential surface and holds lubricant therein; and the tip end of the cleaning blade feeds the lubricant in the recess to part of the outer circumferential surface of the photosensitive drum which is brought into contact with the cleaning blade to form a thin film of the lubricant upon contacting with the lubricant held in the recess as the photosensitive drum is rotated.

U.S. Pat. No. 4,825,249 entitled "Cleaning blade for use with photoelectronic copying machine" discloses an improved cleaning blade for a photoelectronic copying machine. It has a sharp, resilient edge and is superior in wear resistance, and lubricating and cleaning properties. The substrate of the cleaning blade is urethane rubber and is coated with perfluoropolyether having a main structural unit represented by—C.sub.x F.sub.2x —O— (x is 1, 2, 3 or 4) and having an isocyanate, hydroxyl, carboxyl or amino group at least at one end thereof. It may be coated with a mixture of the perfluoropolyether and an isocyanate group or a hydroxyl group.

U.S. Pat. No. 5,450,184 entitled "Cleaning blade for electrophotography, cleaning device for electrophotography, apparatus unit, electrophotographic apparatus and facsimile apparatus" discloses a cleaning blade for electrophotography has a blade body having a rubbery elasticity and a coating layer covering the surface of the blade body. The coating layer is composed of lubricating particles and a binder resin having a lubricability and a wear resistance. The blade body extends parallel to an axis of the latent image support.

When a cleaning blade as above is used to clean the photosensitive surface of the photoreceptor or imaging member, the blade is arranged to wipe but more frequently to scrape such surface in order to effectively remove residual toner. In order to be effective, the cleaning edge of the blade must be pressed against the surface being scraped. Unfortunately however, elastomeric blades pressed as such in use can be damaged when operated under low lubrication conditions and high friction loads. Low lubrication can create excessive blade wear causing premature failures or catastrophic failures such as blade flips. Given an elongate blade spanning as well as overlapping the entire width of the photoreceptor including the centrally located imaging region and the non-imaging edge portions thereto, the two inboard and outboard ends of the cleaning blade contacting such non-imaging edge portions are especially prone to low lubrication conditions. This is because the non-imaging edge portions typically receive little or no toner from imaging so as to provide lubrication to the inboard and outboard ends of the blade. End seals in the cleaner apparatus housing that overlap the blade may further inhibit any toner from reaching the blade ends.

As a consequence catastrophic blade failures such as a blade flip typically start from one such blade end and then progresses across the full length of the blade. Conventionally, this problem has usually been addressed by attempts at minimizing the length of blade, and hence the dimensions of the inboard and outboard ends overlapping or extending into the low lubrication non-imaging edge portions of the photoreceptor. Even so, blade-length tolerances due to even manual assembly of the blade into machines still frequently result in at least some level of blade overlap and hence blade ends lubrication problems.

SUMMARY

In accordance with the present disclosure, there has been provided a high load low load cleaning blade assembly for cleaning a toner image bearing surface that includes a blade member having a first edge mounted to a frame, a second and opposite edge for contacting and loading against the toner image bearing surface, and a blade width connecting the first edge to the second edge. The high load low load blade assembly also includes a blade holder for holding and loading the blade member against the moving toner image bearing surface. The holder includes a frame, and a blade loading plate operatively connected to the frame and extending from the frame towards the second edge of the blade for stiffening the blade width and determining a resulting blade loading force of each portion of the second edge against regions of the toner image bearing surface. The blade loading plate includes a central segment having a first plate width for stiffening the central portion of the blade member, and end segments, each having a second plate width less than the first plate width, for stiffening end portions of the blade member, thereby resulting in a second edge having a high load central portion and low load end portions.

BRIEF DESCRIPTION OF THE DRAWINGS

In the detailed description below, reference is made to the drawings, in which.

DETAILED DESCRIPTION

Figure 1:
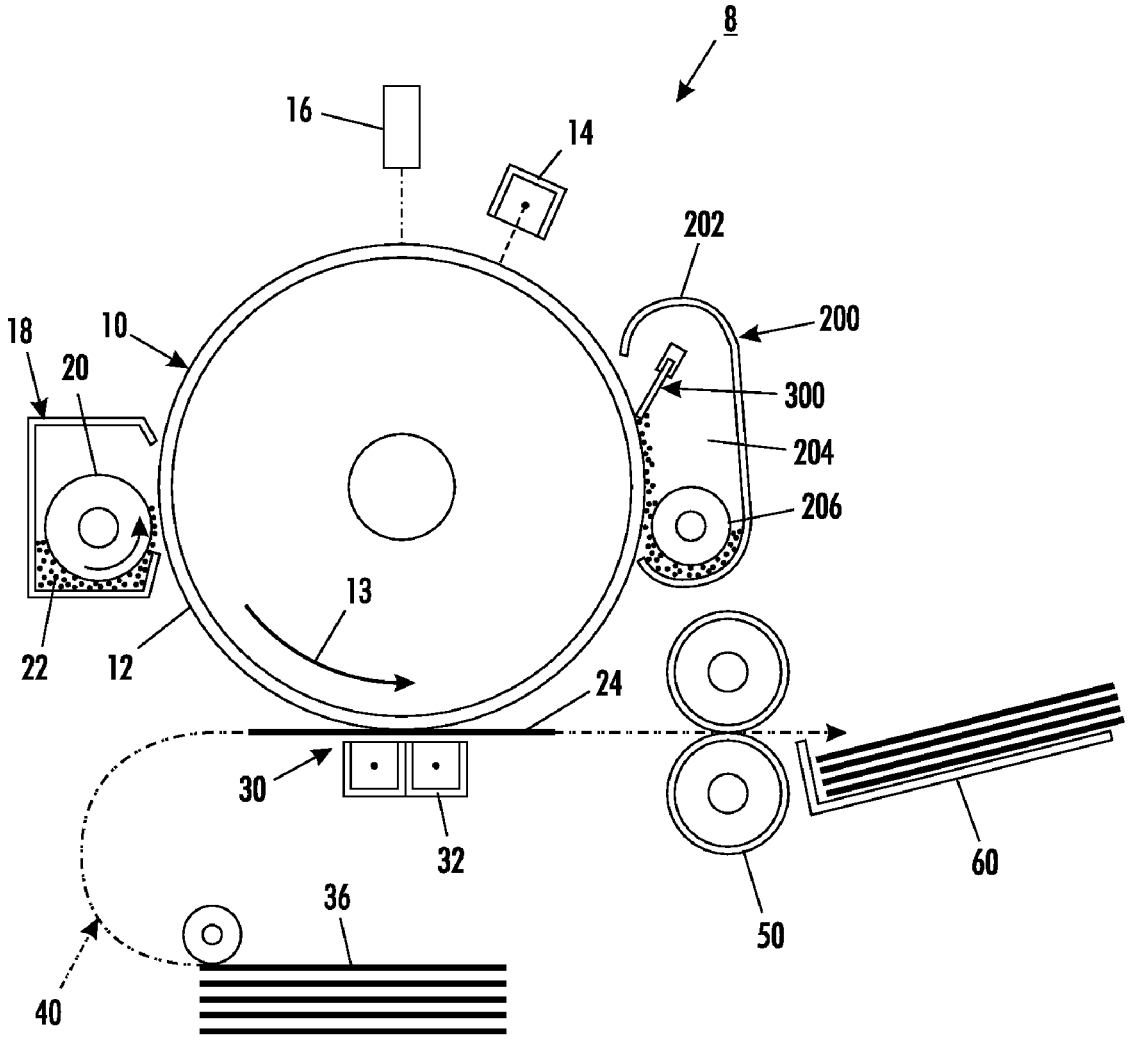
FIG. 1 is a simplified elevational view showing relevant elements of a toner imaging electrostatographic machine including the high load low load cleaning blade assembly of the present disclosure.

Referring now to FIG. 1, FIG. 1 is a simplified elevational view showing relevant elements of an electrostatographic or toner-imaging machine 8. As is well known, a charge receptor or photoreceptor 10 having an imageable surface 12 and rotatable in a direction 13 is uniformly charged by a charging device 14 and image-wise exposed by an exposure device 16 to form an electrostatic latent image on the surface 12. The latent image is thereafter developed by a development apparatus 18 that for example includes a developer roll 20 for applying a supply of charged toner particles 22 to such latent image. The developer roll 20 may be of any of various designs such as a magnetic brush roll or donor roll, as is familiar in the art. The charged toner particles 22 adhere to appropriately charged areas of the latent image. The surface of photoreceptor 10 then moves, as shown by the arrow 13, to a transfer zone generally indicated as 30. Simultaneously, a print sheet 24 on which a desired image is to be printed is drawn from a sheet supply stack 36 and conveyed along a sheet path 40 to the transfer zone 30.

At the transfer zone 30, the print sheet 24 is brought into contact or at least proximity with the surface 12 of photoreceptor 10, which at this point is carrying toner particles thereon. A corotron or other charge source 32 at transfer zone 30 causes the toner image on photoreceptor 10 to be electrostatically transferred to the print sheet 24. The print sheet 24 is then forwarded to subsequent stations, as is familiar in the art, such as a fuser station 50, and then to an output tray 60.

Following such transfer of a toner image from the surface 12 to the print sheet 24, any residual toner particles remaining on the surface 12 are removed by a toner image bearing surface cleaning apparatus 200 that includes for example a high load low load cleaning blade assembly 300 of the present disclosure. As shown, the toner image bearing surface cleaning apparatus 200 has a housing 202 that defines a chamber 204 that includes the high load low load cleaning blade assembly 300 of the present disclosure (to be described in detail below). The high load low load cleaning blade assembly 300 is mounted within the chamber 204 for scraping the moving surface 12 and removing residual toner particles therefrom. The cleaning apparatus 200 also includes means such as an auger device 206 for discharging residual toner particles from the housing 202.

Figure 2:
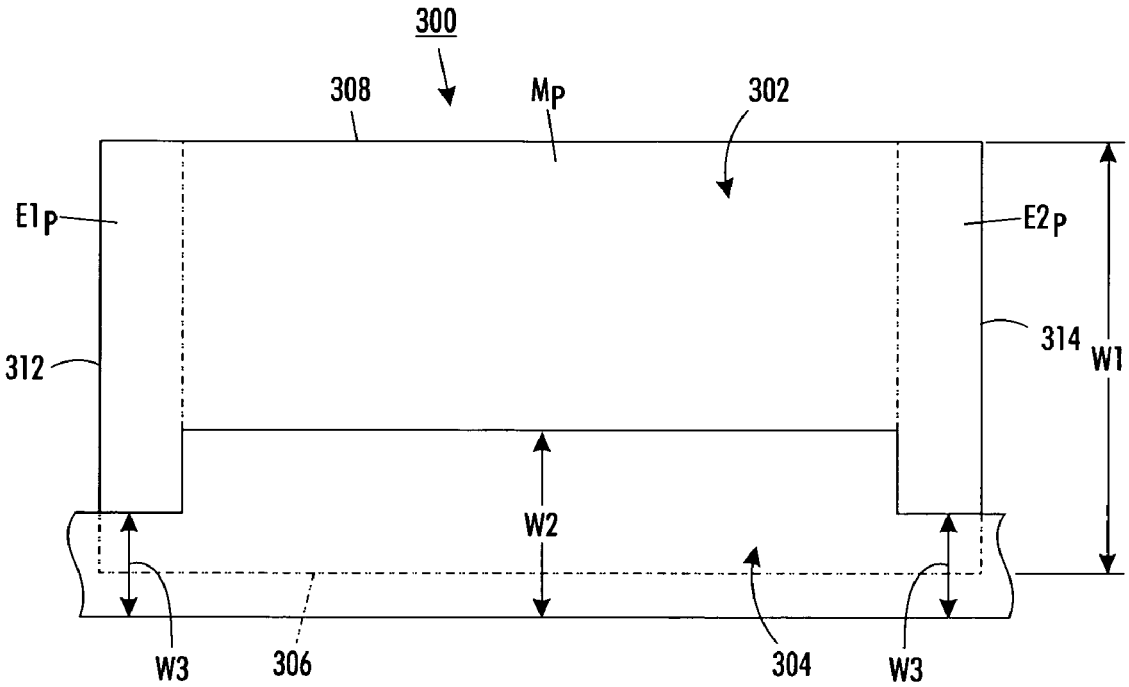
FIG. 2 is a plan view of a high load low load cleaning blade assembly of the present disclosure.
Figure 3:
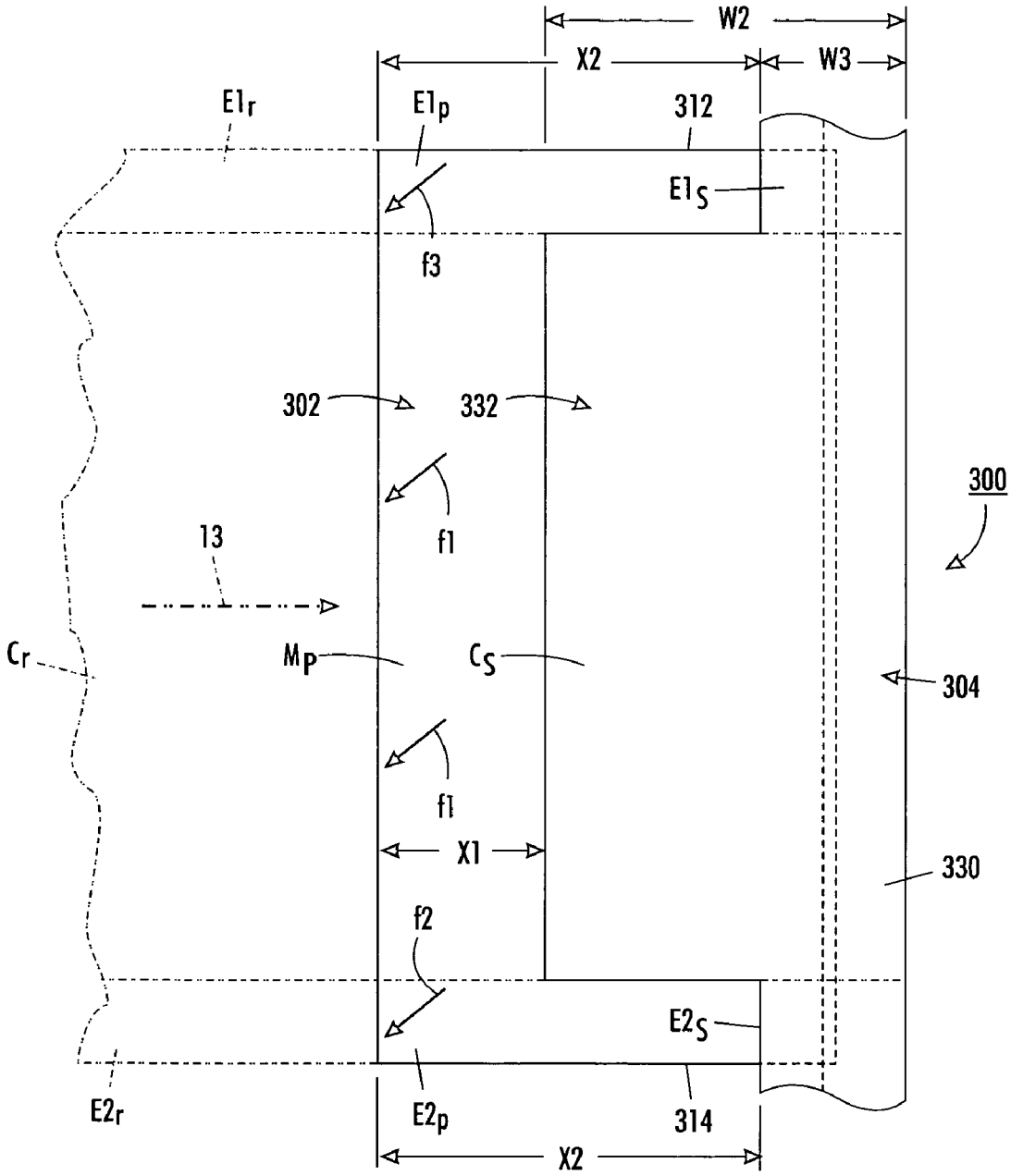
FIG. 3 is a plan view of the high load low load cleaning blade assembly of FIG. 2 in cleaning engagement with a toner image bearing surface in accordance with the present disclosure.

Referring to FIGS. 1-3, the high load low load cleaning blade assembly 300 of the present disclosure and its application are illustrated in detail in FIGS. 2-3. As shown, the high load low load cleaning blade assembly 300 includes a one-piece elongate blade member 302 having (i) a first end 312, (ii) a second end 314, (iii) a first elongate edge 306 connecting the first end 312 and the second end 314, (iv) a second elongate edge 308 opposite the first elongate edge 306 for contacting and loading against the toner image bearing surface 12, and (v) an overall blade width W1 connecting the first elongate edge 306 to the second elongate edge 308. As further illustrated, the one-piece elongate blade member 302 can be seen as further comprising (a) an imaging mid-portion Mp for applying a first edge-loading high load force f1 for frictionally contacting and cleaning a corresponding central imaging region Cr of the moving toner image bearing surface 12, (b) a first end portion E1*p*, and a second end portion E2*p*, located towards the first end 312 and the second end 314 respectively, for applying a second different edge-loading low load force f2, and a third different edge-loading low load force f3 respectively to lightly contact and clean corresponding non-imaging edge regions E1*r*, E2*r* of the moving toner image bearing surface 12. By design, f3 is made equal to f2.

The high load low load cleaning blade assembly 300 also includes an elongate blade holder 304 for holding and loading the one-piece elongate blade member 302 against the moving toner image bearing surface 12. In accordance with the present disclosure, the elongate blade holder 304 may include (i) a frame or frame portion 330 for mounting to the first elongate edge 306 of the one-piece elongate blade member 302 and (ii) a blade loading plate or plate portion 332 operatively connected to the frame 330 and extending from such frame 330 towards the second elongate edge 308 of the blade member 302 for stiffening the blade width W1 and determining the resulting blade loading force f1, f2, f3 (FIG. 3) of each portion (Mp, E1*p*, E2*p*) of the second elongate edge 308 against regions (Cr, E1*r*, E2*r*) of the toner image bearing surface 12. As shown, the blade loading plate 332 includes a central segment Cs having a first plate width W2 for stiffening a imaging mid-portion or central portion Mp of the one-piece elongate blade member 302. The blade loading plate 332 also includes end segments E1*s*, E2*s*, for stiffening the corresponding end portions E1*p*, E2*p* respectively of the one-piece elongate blade member 302. The end segments E1*s* and E2*s* each have a second plate width W3 that is less than the first plate width W2, and as a consequence, the central portion Mp has an unsupported blade width dimension X1 that is significantly shorter and hence stiffer than the unsupported blade width dimensions X2 at each of the end portions E1*p*, E2*p* of the blade member 302. This thereby results in the second elongate edge 308 applying a high load force f1 from the central portion MP and low load forces f2, f3 at the end portions thereof.

In accordance with the present disclosure, the high load low load blade assembly 300 effectively results in a reduction in blade end loading forces f2, f3 against the non-imaging edge regions E1*r*, E2*r* respectively of the photoreceptor surface 12. Such reduction advantageously tends to prevent blade damage and blade failures even under low lubrication conditions. As shown, the blade-end loading forces f2, f3 are reduced by providing at the first and second end portions or inboard and outboard ends E1*p*, E2*p* of the blade member 302 (compared to the central portion Mp) a relatively greater un-supported blade width dimension or extension dimension X2 of the ordinarily flexible blade member 302 as shown. This can be easily and inexpensively accomplished through changes to a standard, die-formed, sheet metal blade holder 304.

It has been found that blade loads f2, f3 of less than 8 g/cm ordinarily result in no blade flips, and in only low wear under even very low lubrication conditions. Accordingly, the unsupported blade width dimension X2 of the first and second blade end portions E1*p*, E2*p* is selected so that the blade-end loads f2, f3 will be 8 g/cm or less under given blade loading conditions. Thus the end segments E1*s*, E2*s* of the blade loading plate 332 are adapted for producing a blade edge loading force of at most 8 g/cm at the first and second end portions E1*p*, E2*p*. Additionally, no cleaning problems were observed across a transition from the X1 unsupported blade width dimension high load f1 at the center to each of the low load forces f2, f3. For best performance, the full length (elongate edge 308) of the blade member 302, including the center, and ends Mp, E1*p*, E2*p* would be provided with some initial start-up lubrication.

In one embodiment, the frame 330 and blade loading plate 332 can be formed as a single unit or item out of the same material, such as sheet metal. In such a case, the relatively increased unsupported blade width dimensions X2 at the ends can be formed by end notches, or cut outs in the blade loading plate 332 portion as shown. The cut outs for example can be formed so that the transition from W2 to W3 is abrupt as shown, or gradual hence with a slant going from W2 to W3.

Testing of blade members 302 on the blade holder 304 of the present disclosure, and at various loads and working angles was performed to determine what conditions provided good operation with very low lubrication. A boundary for blade flip failures was found between 23 g/cm and 14 g/cm. A boundary for visible wear after more than 27 k photoreceptor cycles was found at about 8 g/cm. None of the blade members tested failed to clean (except blades that flipped) at the end of the test. The test was run for 27 k photoreceptor cycles (7.1 km of sliding) under low or very low lubrication conditions. The initial 2.2 k cycles were run with a moderate amount of start-up toner lubrication. Following that the photoreceptor and blade members were wiped clean of toner a total of five times. After the first wiping the highest loaded blade flipped early in the first minute of running. No further toner was intentionally supplied to the blades during the remainder of the test. In fact, as much toner as possible was removed from the blades and from the photoreceptor.

The benefits of lowered loads on the ends of blades are improved reliability, reduced assembly and manufacturing tolerances, lowered service cost and improved customer satisfaction. Reliability is improved because early failures due to low lubrication blade flips are eliminated. The need for tight blade length tolerance control, blade assembly onto the blade holder tolerance control, and precise positioning of the blade relative to the central imaging region on the photoreceptor, can be relaxed. Survival of the first and second portions E1*p*, E2*p* is due primarily to modifications in the blade holder 304 rather than in the positioning of both first and second portions E1*p*, E2*p* on the blade holder 304 relative to positioning of the central portion Mp of the blade over the central imaging region Cr.

As an additional benefit, service cost is reduced due to the improved blade reliability. Early failures due to blade flips will almost always generate unscheduled maintenance (UM) service calls. These are very expensive in terms of service representative travel time, machine maintenance checks, interaction with the customer and actual repair time. The customer is not only upset because the machine is down, but because the service representative has typically just been to the site to replace the blade (perhaps as part of a xerographic CRU). A small improvement in reliability, especially elimination of early failure modes, can greatly reduce service cost and increase customer satisfaction with the machine.

As can be seen, there has been provided a high load low load cleaning blade assembly for cleaning a toner image bearing surface that includes a blade member having a first edge mounted to a frame, a second and opposite edge for contacting and loading against the toner image bearing surface, and a blade width connecting the first edge to the second edge. The high load low load blade assembly also includes a blade holder for holding and loading the blade member against the moving toner image bearing surface. The blade holder includes a frame, and a blade loading plate operatively connected to the frame and extending from the frame towards the second edge of the blade member for stiffening the blade width and determining a resulting blade loading force of each portion of the second edge against regions of the toner image bearing surface. The blade loading plate includes a central segment having a first plate width for stiffening the central portion of the blade member, and end segments, each having a second plate width less than the first plate width, for stiffening end portions of the blade member, thereby resulting in a second edge having a high load central portion and low load end portions.

It will be appreciated that various of the above-disclosed and other features and functions of this embodiment, or alternatives thereof, may be desirably combined into other different systems or applications. Also that various presently unforeseen or unanticipated alternatives, modifications, variations or improvements therein may be subsequently made by those skilled in the art which are also intended to be encompassed by the following claims.

What is claimed is:

1. A high load low load cleaning blade assembly for cleaning a toner image bearing surface comprises:

(a) a blade member having a first edge mounted to a frame, a second and opposite edge for contacting and loading against said toner image bearing surface, and a blade width connecting said first edge to said second edge; and (b) a blade holder for holding and loading said blade member against said toner image bearing surface, said blade holder including a frame, and a blade loading plate operatively connected to said frame and extending from said frame towards said second edge of said blade member for stiffening said blade width and determining a resulting blade loading force of each portion of said second edge against regions of said toner image bearing surface, said blade loading plate including a central segment having a first plate width for stiffening a central portion of said blade member, and end segments, each having a second plate width less than said first plate width, for stiffening end portions of said blade member, thereby resulting in the second edge having a high load central portion and low load end portions.

2. The high load low load cleaning blade assembly of claim 1, wherein said blade member is made of a urethane material.

3. The high load low load cleaning blade assembly of claim 1, wherein said blade holder is made of sheet metal.

4. The high load low load cleaning blade assembly of claim 1, wherein said blade member is flexible.

5. The high load low load cleaning blade assembly of claim 1, wherein said end segments of said blade loading plate are adapted for producing a loading force of at most 8 g/cm.

6. A toner image bearing surface cleaning apparatus comprising:

(a) a cleaning housing positioned centrally relative to an edge-to-edge dimension of a toner image bearing surface for cleaning said moving toner image bearing surface by removing charged residual toner particles, and (b) a high load low load cleaning blade assembly having (i) a blade member including a first edge mounted to a frame, a second and opposite edge for contacting and loading against said toner image bearing surface, and a blade width connecting said first edge to said second edge; and (ii) a blade holder for holding and loading said blade member against said moving toner image bearing surface, said blade holder including a frame, and a blade loading plate operatively connected to said frame and extending from said frame towards said second edge of said blade member for stiffening said blade width and determining a resulting blade loading force of each portion of said second edge against regions of said toner image bearing surface, said blade loading plate including a central segment having a first plate width for stiffening a central portion of said blade member, and end segments, each having a second plate width less than said first plate width, for stiffening end portions of said blade member, thereby resulting in the second edge having a high load central portion and low load end portions.

7. The toner image bearing surface cleaning apparatus of claim 6, wherein said blade member is made of a urethane material.

8. The toner image bearing surface cleaning apparatus of claim 6, wherein said blade holder is made of sheet metal.

9. The toner image bearing surface cleaning apparatus of claim 6, wherein said blade member is flexible.

10. The toner image bearing surface cleaning apparatus of claim 6, wherein said end segments of said blade loading plate are adapted for producing a loading force of at most 8 g/cm.

11. An electrostatographic reproduction machine comprising:

(a) a movable toner image bearing member having a toner image bearing surface including a centrally located imaging region and first and second edge regions flanking said imaging region;

(b) toner image forming devices mounted along a path of movement of said toner image bearing surface for forming a toner image on said toner image bearing surface;

(c) transfer means for transferring said toner image from said toner image bearing surface onto a substrate; and (d) a toner image bearing surface cleaning apparatus positioned centrally relative to an edge-to-edge dimension of said toner image bearing surface for cleaning said toner image bearing surface by removing charged residual toner particles, said toner image bearing surface cleaning apparatus including a high load low load cleaning blade assembly having (i) a blade member including a first edge mounted to a frame, a second and opposite edge for contacting and loading against said toner image bearing surface, and a blade width connecting said first edge to said second edge; and (ii) a blade holder for holding and loading said blade member against said toner image bearing surface, said blade holder including a frame, and a blade loading plate operatively connected to said frame and extending from said frame towards said second edge of said blade member for stiffening said blade width and determining a resulting blade loading force of each portion of said second edge against regions of said toner image bearing surface, said blade loading plate including a central segment having a first plate width for stiffening a central portion of said blade member, and end segments, each having a second plate width less than said first plate width, for stiffening end portions of said blade member, thereby resulting in the second edge having a high load central portion and low load end portions.

12. The electrostatographic reproduction machine of claim 11, wherein said blade member is made of a urethane material.

13. The electrostatographic reproduction machine of claim 11, wherein said blade holder is made of sheet metal.

14. The electrostatographic reproduction machine of claim 11, wherein said blade member is flexible.

15. The electrostatographic reproduction machine of claim 11, wherein said end segments of said blade loading plate are adapted for producing a loading force of at most 8 g/cm.

16. The electrostatographic reproduction machine of claim 11, wherein said blade member comprises a one-piece elongate blade member.

17. The electrostatographic reproduction machine of claim 11, wherein said frame and said blade loading plate are formed as single item.

18. The electrostatographic reproduction machine of claim 11, wherein said frame and said blade loading plate are each made of sheet metal.

19. The electrostatographic reproduction machine of claim 11, including an auger device within said toner image bearing surface cleaning apparatus for discharging toner particles from said toner image bearing surface cleaning apparatus.

20. A high load low load cleaning blade assembly for cleaning a toner image bearing surface having an imaging region and non-imaging edge regions, the high load low load cleaning blade assembly comprising:

(a) a one-piece elongate blade member having (i) a first end, (ii) a second end, (iii) a first elongate edge connecting said first end and said second end, (iv) a second elongate edge opposite said first elongate edge for contacting and loading against said toner image bearing surface, and (v) a blade width connecting said first elongate edge to said second elongate edge; and (b) an elongate blade holder for holding and loading said one-piece elongate blade member against said toner image bearing surface, said elongate blade holder including (i) a frame for mounting to said first elongate blade edge of said one-piece elongate member and (ii) a blade loading plate operatively connected to said frame and extending from said frame towards said second elongate edge for stiffening said blade width and determining a resulting blade loading force of each portion of said second elongate edge against regions of said toner image bearing surface, said blade loading plate including a central segment having a first plate width for stiffening the blade width of a central portion of said one-piece elongate blade member and end segments each having a second plate width less than said first plate width for stiffening the blade width of portion of said one-piece elongate blade member, thereby resulting in the second elongate edge having a high load central portion and low load end portions.

* * * * *